United States Patent [19]

Weiner

[11] 4,417,730

[45] Nov. 29, 1983

[54] TENNIS PRACTICE APPARATUS

[76] Inventor: Todd D. Weiner, 628 Binsted Rd., Glen Burnie, Md. 21061

[21] Appl. No.: 374,296

[22] Filed: May 3, 1982

[51] Int. Cl.[3] ..... A63B 61/00

[52] U.S. Cl. ..... 273/29 A

[58] Field of Search ..... 273/29 A, 26 R, 58 C, 273/26 A, 26 E, 184 B, 185 D, 185 E, 208, 200 B, 183 C, 186 C, 197 R, 197 A, 196, 198, 260; 272/76, 77, 78; 124/7

[56] References Cited

U.S. PATENT DOCUMENTS

| | | | |
|---|---|---|---|
| 1,679,174 | 7/1928 | Richards et al. | 272/76 |
| 2,082,818 | 6/1937 | Atwell | 273/26 R |
| 2,578,313 | 12/1951 | Moseley | 273/26 R |
| 2,713,487 | 7/1955 | Jaedikes | 273/29 A |
| 3,661,679 | 1/1975 | Culpepper | 273/29 A |
| 3,876,203 | 4/1975 | Gold | 273/29 A |
| 4,089,521 | 5/1978 | Berst et al. | 273/29 A |
| 4,204,678 | 5/1980 | Weis | 273/29 A |

FOREIGN PATENT DOCUMENTS

| | | | |
|---|---|---|---|
| 432639 | 8/1926 | Fed. Rep. of Germany | 272/78 |
| 2232339 | 1/1975 | France | 273/29 A |
| 370590 | 4/1932 | United Kingdom | 273/29 A |

*Primary Examiner*—Richard C. Pinkham
*Assistant Examiner*—T. Brown
*Attorney, Agent, or Firm*—Epstein & Edell

[57] ABSTRACT

Tennis practice apparatus movably positions a ball to be struck with a tennis racket while the ball is moving to improve a player's physical coordination and timing. The apparatus is portable to be used either indoors or outdoors and includes a pivoted arm carrying the ball controlled by resilient members to cause the arm and the ball to oscillate about a stationary position to permit the player to strike the ball as the ball is moving toward the player providing a natural feel.

10 Claims, 13 Drawing Figures

50
38
56
29
20
65
66
62
64
80
83
87
88
86
63
92
73
67
74
72
69
84
85
82
81
78
75
76
77
68
70
71

TENNIS PRACTICE APPARATUS

TECHNICAL FIELD

The present invention relates generally to practice and training equipment for sport and exercise and, more particularly, to apparatus for improving a tennis player's coordination and timing as well as improving many of the ground strokes associated with the game of tennis.

BACKGROUND OF THE INVENTION

Heretofore, many efforts have been made to provide an apparatus for use by a player to improve his coordination and timing as well as for use as an exercise device for improving muscle tone and the like. Generally, these prior efforts have been limited to particular sports, such as tennis, golf, tether ball and the like, since each sport requires different physical abilities and different muscular coordination to improve a player's timing and different phases of each sport require different coordination and timing. For example, in the game of tennis, the serve is entirely different from ground strokess, and even ground strokes differ as noted by the different strokes required for driving overspin shots as compared with lob shots.

Many prior art apparatus for practicing tennis include an elongate, pivoted arm with a ball mounted at one end and a resilient member attached to the arm intermediate the ball and the pivot so that when the ball is struck by a racket, the arm pivots about its axis of rotation until it engages a rebound surface after which the resilient member returns the arm to a stop which holds the arm in an upright position. One of the disadvantages of such apparatus is that the ball is usually in a fixed position when struck. U.S. Pat. Nos. 2,578,313 to Moseley, 2,713,487 to Jaedikes and 3,924,853 to Schleeger are exemplary of such apparatus.

In some prior art apparatus, the ball is freely supported on one end of a pivoted arm having a resilient member attached thereto when the arm is held in a cocked position. When the arm is released, the resilient member pivots the arm to a vertical position against a stop and the ball is propelled in free flight toward a player. This type of apparatus has the disadvantages of requiring a large space for use, retrieval of the ball and recocking of the apparatus after each use. An example of this type of apparatus is shown in U.S. Pat. No. 2,080,958 to Beasley et al.

In other prior art apparatus, a pivotally mounted arm has been provided with a ball attached to one end and one or more resilient members attached to the arm to cause the arm to oscillate when the ball is struck by a racket or the like. In some cases, such as U.S. Pat. No. 3,876,203 to Gold, a plurality of springs are attached to the arm to produce a disadvantageous erratic movement of the ball. In other cases, such as British Pat. No. 370,590 to Stygall, the axis of rotation of the arm is located intermediate its ends, and the resilient member is attached to the end of the arm remote from the ball. This type of device imparts a substantial stretch or elongation to the resilient member and has the disadvantage of producing an unnatural feel when the ball is struck.

SUMMARY OF THE INVENTION

Accordingly, it is a primary object of the present invention to provide a tennis practice, training and exercising apparatus overcoming the above mentioned disadvantages of the prior art.

Another object of the present invention is to provide portable tennis practice apparatus having a moving target to permit an individual to increase physical coordination and train under conditions similar to game conditions.

A further object of the present invention is to provide tennis practice apparatus in which the tension of a pair of springs is easily adjustable for faster or slower action depending upon the skill and desire of the individual.

Some of the advantages of the present invention over the prior art are that the tennis practice apparatus of the present invention presents a controllable, oscillating tennis ball target for striking by a player with the movement of the ball simulating game conditions, is inexpensive to manufacture and is versatile for use in various locations while being easily portable and simple to set up and use.

The present invention is generally characterized in an apparatus for moving a ball to be struck by a racket for practice including an elongate arm having a mounting end and a target end carrying a ball to be struck by a racket, a support assembly pivotally mounting the arm at the mounting end to permit the target end to move through a stationary position in opposite directions and limiting pivotal movement of the arm to less than 360°, and spring means connected at a first end with the arm and at a second end with the support assembly at a position spaced from the mounting end of the arm, the spring means being aligned along the arm to bias the arm toward said stationary position such that pivotal movement of the arm in a first direction from the stationary position tensions the spring means to bias the arm to move in a second direction opposite to the first direction whereby striking of the ball carried on the target end of the arm with a racket causes the ball to oscillate about the stationary position for striking again with the racket while the ball is moving.

Other objects and advantages of the present invention will become apparent from the following description of the preferred embodiments taken in conjunction with the accompanying drawings.

DESCRIPTION OF THE PREFERRED EMBODIMENTS

Figure 1:
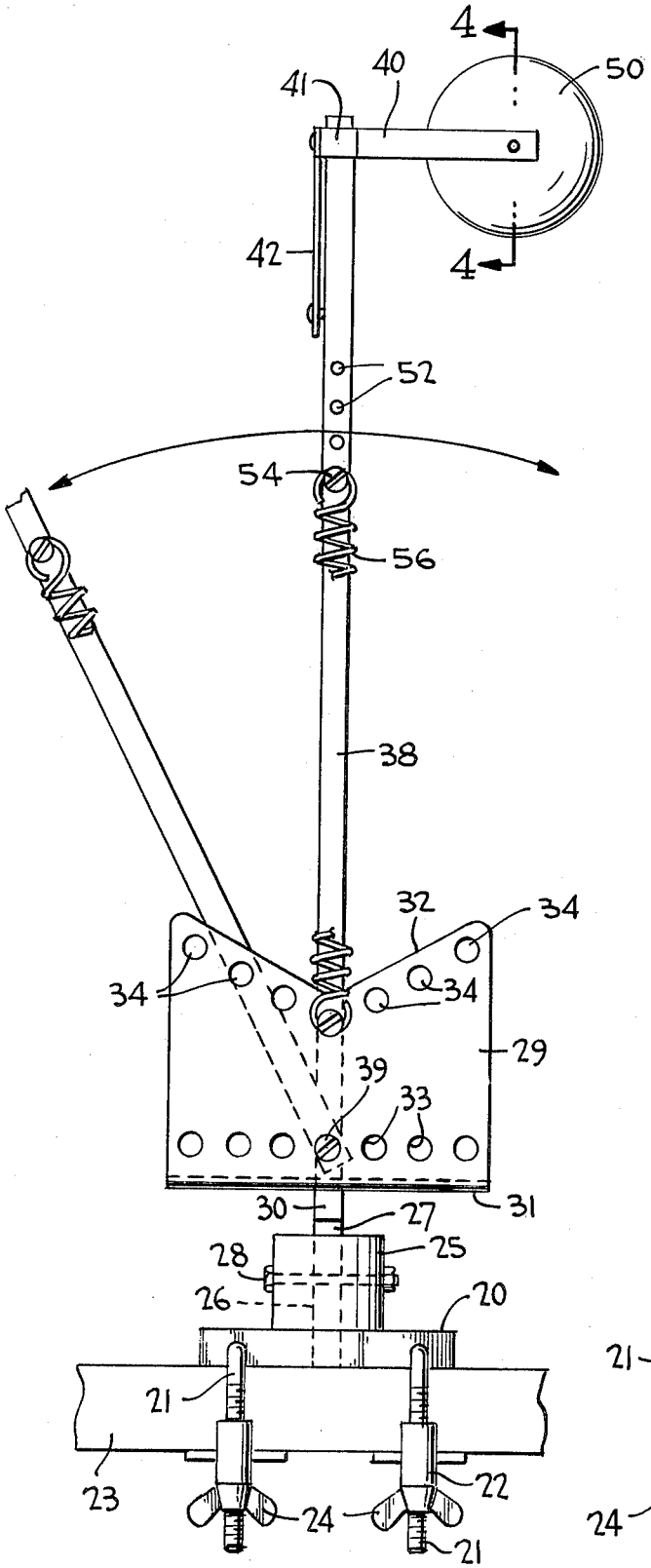
FIG. 1 is a side elevation of tennis practice apparatus according to the present invention.

Tennis practice apparatus according to the present invention is illustrated in FIGS. 1–8 and includes a base 20 having a pair of generally parallel openings which slidably receive the upper portions of a pair of L-shaped clamping pins 21. Vertically extending portions of pins 21 slidably receive clamp members 22 which are urged into intimate engagement with the lower surface of a ledge 23, such as a table top or the like, by wing nuts 24 or other fasteners threadedly engaging the vertical portions of the pins 21 such that the base 20 engages and is supported by the upper surface of the ledge 23. The central portion of the base 20 has an upstanding boss or projection 25 with an axial opening 26 extending entirely through the projection and the base.

A post 27 has one end located within the opening 26 and the opposite end extending above the boss 25, the post being fixed to the boss by a screw and nut 28 or other fastener. A pair of spaced, generally parallel, support wings or plates 29 having downwardly extending tongs 30 are welded or otherwise attached to opposite sides of the upper end of the post 27. The lower edge 31 of each wing is generally parallel with the upper surface of the base 20, and the upper edge 32 of each wing has a shallow V-shaped configuration. A first series of openings 33 extend through each wing 29 adjacent the lower edge 31 and a second series of openings 34 extend through each wing adjacent and generally parallel with the V-shaped upper edge 32, the lower openings 33 being in substantially vertical alignment with the upper openings 34.

Figure 3:
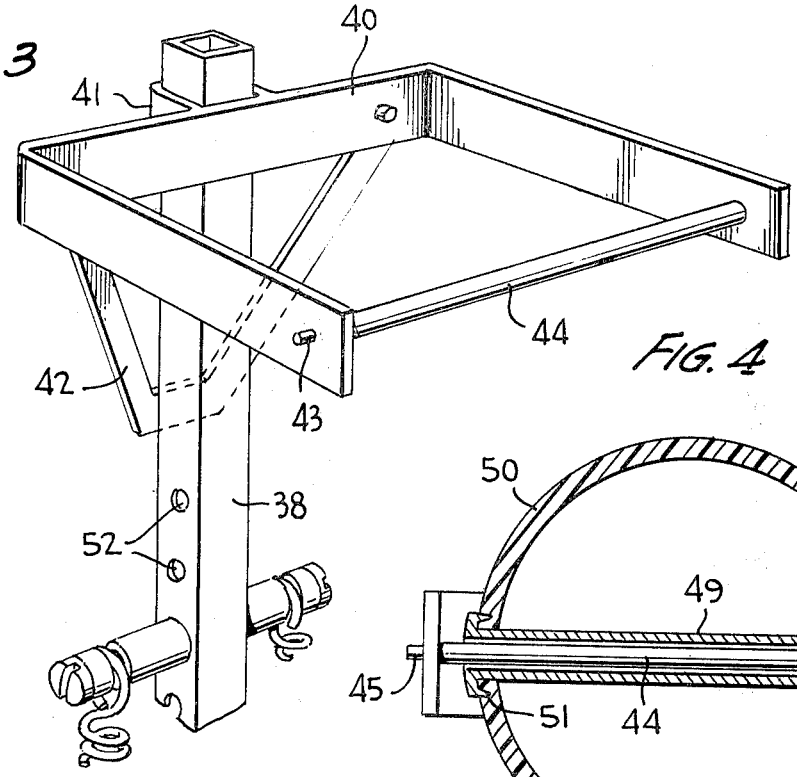
FIG. 3 is a perspective of a ball supporting target end of the tennis practice apparatus of the present invention.
Figure 4:
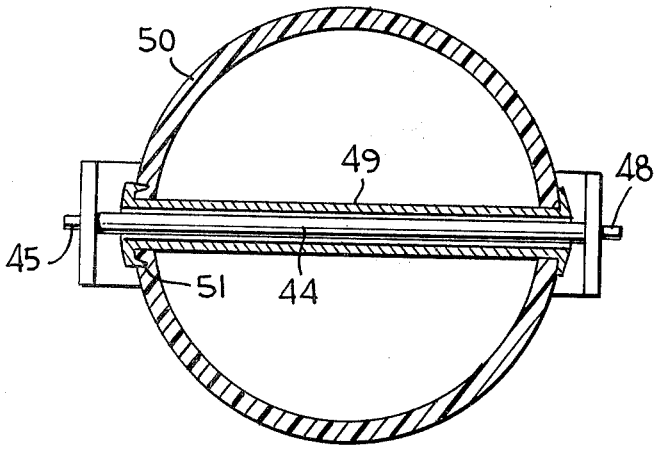
FIG. 4 is a section taken along line 4—4 of FIG. 1.
Figure 5:
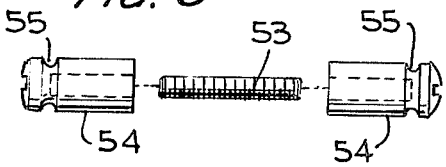
FIG. 5 is an exploded view of upper spring receiving pegs of the tennis practice apparatus of the present invention.
Figure 6:
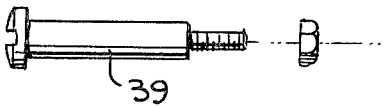
FIG. 6 is an exploded view of a fastener for pivotally attaching an elongated arm to a pair of spaced parallel support wings of the tennis practice apparatus of the present invention.
Figure 8:
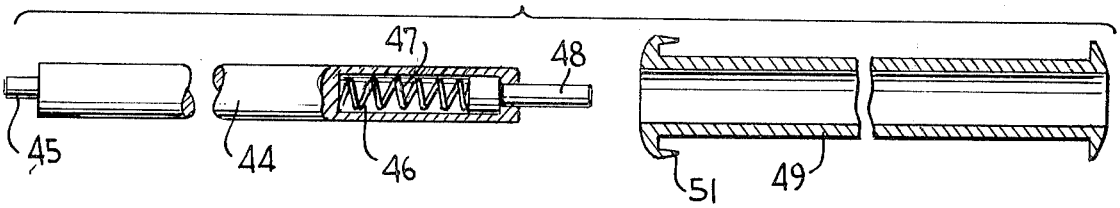
FIG. 8 is an exploded view, partly in section, of a ball mounting spindle of the tennis practice apparatus of the present invention.
Figures 9, 10, 11:
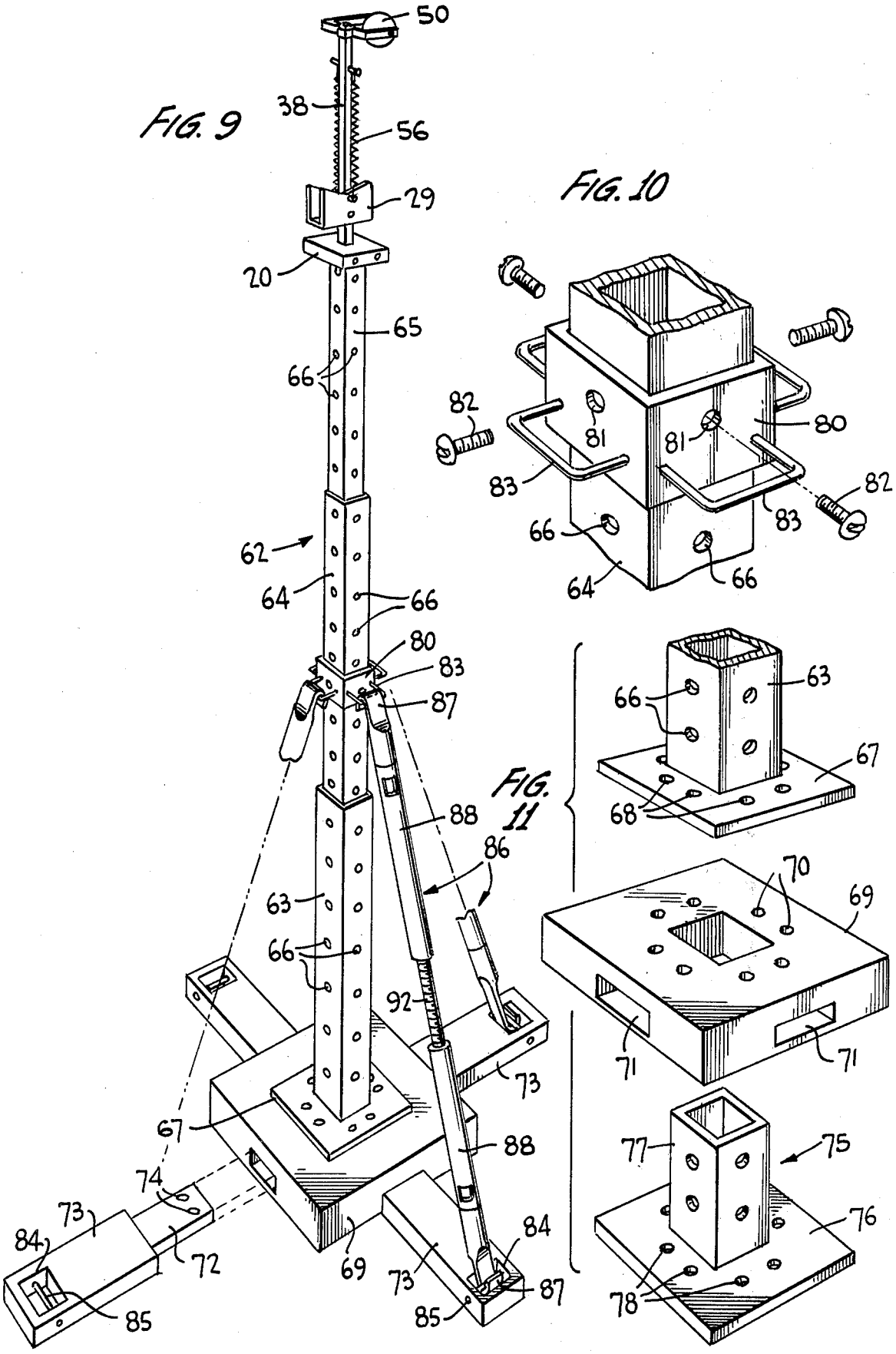
FIG. 9 is a perspective view of another embodiment of the tennis practice apparatus of the present invention.
FIG. 10 is a broken perspective of an attachment collar mounted on a telescoping column of the tennis practice apparatus of FIG. 9.
FIG. 11 is an exploded perspective of the base of the column of the tennis practice apparatus of FIG. 9.
Figure 12:
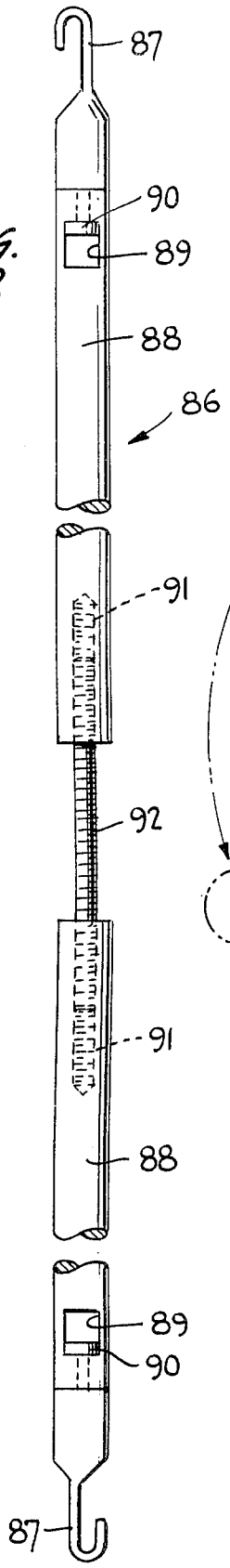
FIG. 12 is a broken elevation of an adjustable brace for the column of the tennis practice apparatus of FIG. 9.

A mounting end of an elongate arm 38 is pivotally mounted on the parallel support wings 29 by a screw and nut 39 in such a manner that the screw functions as a pivot, the screw being selectively received within openings 33 of the wings. The arm 38 has a target end carrying a U-shaped mounting bracket 40 including a collar 41 receiving the arm 38 and connected thereto in any desired manner such as by welding, fasteners or the like. A V-shaped brace 42 has arms attached to the bracket 40 and to the arm 38. With particular reference to FIGS. 3, 4 and 8, the free ends of the arms of the mounting bracket 40 are each provided with an opening 43, and a shaft 44 extends between the arms of the bracket 40 having a pin 45 at one end which is removably received within one of the openings 43. The opposite end of the shaft 44 has a recess 46 receiving a spring 47 and a pin 48 in such a manner that the spring 47 normally urges the free end of the pin 48 outwardly of the end of the shaft 44 so that the pin is received within the opening 43 of the other arm of the bracket 40. A sleeve 49, having an inner diameter of a size to slidably receive the shaft 44, extends diametrically through a tennis ball 50 to form a mounting spindle permitting the ball to spin, and the sleeve has flanged ends disposed along the exterior of the ball to maintain the ball on the sleeve. If desired, one or both of the flanged ends can have one or more prongs 51 penetrating the ball 50. When the sleeve 49 is mounted on the shaft 44, the periphery of the ball extends substantially beyond the ends of the mounting bracket 40.

In order to maintain the arm 38 in a genenerally vertical, stationary position when not in use and to return the arm to the stationary position after the ball 50 has been struck, the arm 38 has a series of spaced holes 52 extending along its length of a size to slidably receive a headless screw 53 (FIG. 5) in a manner such that the screw 53 extends from both sides of the arm 38. An elongated cylindrical peg 54 is threadedly connected to each end of the screw 53, and the inner end of each peg intimately engages the arm 38. Each peg 54 is provided with an annular groove 55 contiguous to the outer end which receives one end of a coiled tension spring 56. The screw 53 can be permanently affixed to one of the pegs 54 or integrally formed therewith in which case only one peg will be threadedly attached to the screw.

Figure 2:
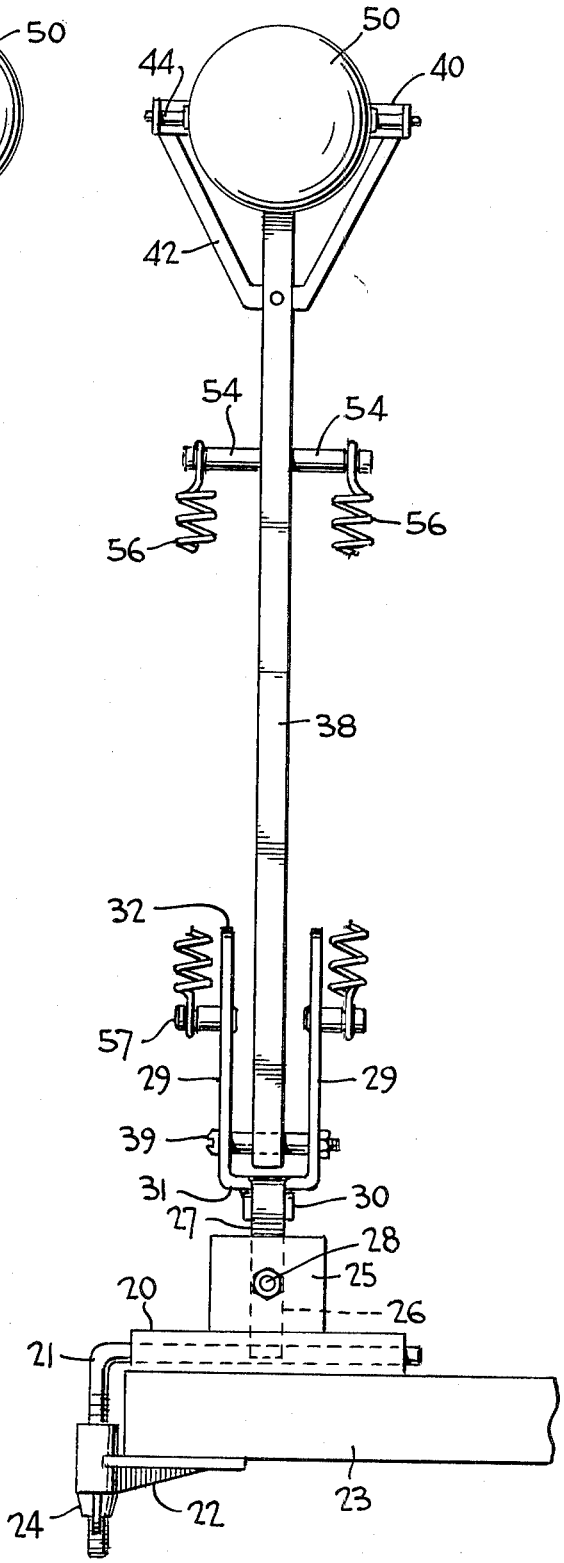
FIG. 2 is a front elevation of the tennis practice apparatus of the present invention.
Figure 7:
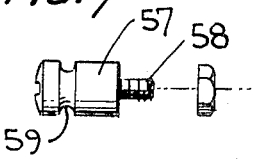
FIG. 7 is an exploded view of a peg for connecting a spring to a support wing of the tennis practice apparatus of the present invention.

As best shown in FIGS. 1, 2 and 7, a relatively short, cylindrical peg 57 having a reduced threaded portion 58 extending through one of the upper openings 34 of the wings 29 is connected to each wing by a nut or the like. Each of the short pegs 57 has an annular recess 59 contiguous to the outer end for receiving the other end of the coil springs 56.

Another embodiment of tennis practice apparatus according to the present invention is shown in FIGS. 9–12 wherein clamping pins 21 and clamp members 22 are removed and the base 20 is mounted on a column 62 including a lower segment 63, an intermediate segment 64 and an upper segment 65 which are telescopically arranged relative to each other. Each of the segments has a plurality of equally spaced openings 66 along each side so that a pin, screw or other fastener (not shown) can be inserted through aligned openings 66 to hold the segments in fixed adjusted position. Although three telescoping segments have been illustrated, it is noted that any desired number of segments can be used. The lower segment 63 is fixed to a plate 67 having a plurality of holes 68. The plate 67 normally rests on and is supported by a substantially square base 69 having a recess (not shown) in the bottom surface. The base 69 has a plurality of holes 70 aligned with the holes 68 of the plate 67. Each side of the base 69 has an inwardly extending opening or recess 71 slidably receiving the reduced portion 72 of an outwardly extending foot 73. Each of the reduced portions 72 extends into the base 69 and has openings 74 which may be aligned with the holes 68 in the plate 67 and the holes 70 of the base 69.

In order to connect the plate 67, base 69, and feet 73 in assembled relationship, a connector 75 (FIG. 11) is provided having a plate 76 and an upstanding core 77. The plate 76 is of a size to be received within the recess in the bottom of the base 69 and is provided with holes 78 aligned with the holes 68 in the upper plate 67, the holes 70 in the base 69 and the openings 74 in the reduced portions of the feet 73. A bolt or other fastener extends through the aligned openings to join the elements together in assembled relationship. The upstanding core 77 extends through the base 69 and is received within the lower segment 63 of the column 62. The core has at least one opening 78 in each side aligned with the holes 68 of the lower segment 63 and connected thereto by a pin or other fastener (not shown).

In order to brace or rigidify the column 62, particularly since the ball mounted on top of the column will be struck by a racket with great force, a collar 80 snugly slidably receives one of the column segments, for example intermediate segment 64, and has an opening 81 extending through each side wall for alignment with the openings 66 in the column segment. Fasteners 82, such as screws or the like, extend through the aligned opening to attach the collar 80 to the segment. Also, each wall of the collar 80 has a U-shaped attachment member 83 welded or otherwise fixed thereto and extending outwardly from the collar. Each foot 73 is provided with a recess 84 in the upper surface adjacent the outer end to accommodate an anchor pin 85 disposed generally parallel to the base 69. As shown best in FIGS. 9 and 12, an adjustable brace 86 connects the attachment member 83 to the anchor pin 85 and includes a hook 87 at each end. A pair of rotatable bars 88 each has a recess 89 adjacent one end for the reception of a pin 90 connected to the adjacent hook in such a manner that the bars are rotatable relative to the hooks. The other end of each bar 88 has a threaded axial opening 91 threadedly receiving one end of an elongated screw 92. One of the hooks 87 engages one of the U-shaped attachment members of the collar 80 and the other hook engages the anchor pin 85 of one of the feet 73. The rotatable bars 88 are rotated to tighten each brace 86 until the column 62 is held in a rigid vertical position.

Figure 13:
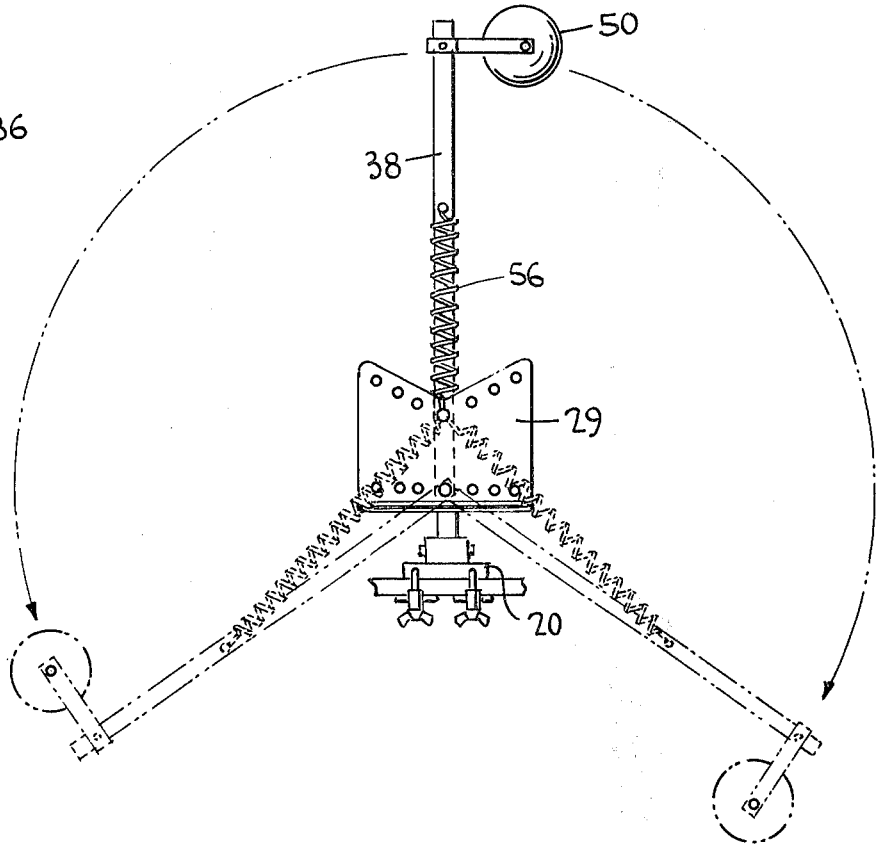
FIG. 13 is a side elevation illustrating the tennis practice apparatus of the present invention in use.

The operation of the tennis practice apparatus of the present invention will be described with reference to FIG. 13. The base 20 is fixed either to a ledge 23 or to the column 62, and the screw 39 is inserted through a selected opening 30 to pivotally mount the elongate arm 38 to the support wings 29 while a pair of short pegs 57 are attached to the wings directly above the screw or pivot 39. The coil springs 56 are extended until the lower ends of the springs are received within the annular recesses 59 of the short pegs 57. If a different tension is desired for the coil springs 56, the elongated pegs 54 can be shifted up or down the elongated arm 38. 01212

When a player is ready to initially strike the ball 50 with a racket, the ball will be in the stationary position or the ball can be manually pushed against the bias of springs 56 to start the arm moving. When the ball is struck, the arm 38 is rotated about the pivot 39 in a counterclockwise direction, looking at FIG. 13. During initial movement of the arm, the coil springs 56 stretch or elongate which increases the inherent energy within the springs until the energy in the springs overcomes the momentum of the arm 38 and momentarily causes the arm to stop and start travel in an opposite clockwise direction through or past the stationary position to swing to the other side of the device until the springs again stop the arm and cause the arm to move in a counterclockwise direction such that the ball oscillates about the stationary position permitting the ball to be struck again while the ball is moving. Preferably, the player will have completed his follow through and returned the racket to a set position by the time the arm moves in a clockwise direction a second time so that player can strike the ball while the ball is moving toward him; however, if the player is not prepared to strike the ball during the second clockwise movement, the ball can be struck on any other clockwise movement as the ball oscillates about the stationary position.

Novice or beginner players may set the coil springs 56 to a lesser tension which reduces the speed of the ball return; and, as the skill of the player increases, the tension on the springs can be increased to cause the ball to return more rapidly.

The support for the arm 38 limits pivotal movement of the arm to less than 360°; and, accordingly, an oscillating movement of the ball 50 is produced permitting players of varying 01318 levels of skill to practice with the tennis practice apparatus of the present invention by hitting the moving ball on the clockwise movement of any cycle resulting from the initial stroke. Of course, the tennis practice apparatus of the present invention could be arranged horizontally or at any angle between vertical and horizontal to move the ball toward a player from any angle or direction; and, it will be appreciated that, since any object can be used to strike the ball, the term "racket" as used herein is meant to include objects other than tennis rackets, such as racquetball rackets, paddles, clubs, bats and the like.

Inasmuch as the present invention is subject to many variations, modifications and changes in detail, it is intended that all subject matter discussed above or shown in the accompanying drawings be interpreted as illustrative and not in a limiting sense.

What is claimed is:

1. Apparatus for moving a ball to be struck by a racket for practice comprising elongate arm means having a mounting end and a target end carrying a ball to be struck by a racket;

support means pivotally mounting said arm means at said mounting end to permit said target end to move through a stationary position in opposite directions and limiting pivotal movement of said arm means to less than 360°; and spring means connected at a first end with said arm means and at a second end with said support means at a position spaced from said mounting end of said arm means, said spring means being aligned along said arm means to bias said arm means toward said stationary position such that pivotal movement of said arm means in a first direction from said stationary position tensions said spring means to bias said arm means to move in a second direction opposite to said first direction whereby striking of said ball carried on said target end of said arm means with a racket causes said ball to oscillate about said stationary position for striking again with the racket while said ball is moving.

2. Apparatus as recited in claim 1 wherein said support means includes adjustment means permitting said spring means to be connected at various positions to adjust the spring bias on said arm means and the speed at which said arm means is moved toward said stationary position after striking of said ball.

3. Apparatus as recited in claim 2 wherein said adjustment means includes a pair of spaced plates extending on opposite sides of said arm means, a first plurality of openings arranged in a line along said plates for pivotally mounting said arm means, and a second plurality of openings arranged in a line along said plates to extend away from said line of first openings for connection with said spring means whereby tension on said spring means varies dependent upon which of said second openings is connected with said spring means.

4. Apparatus as recited in claim 3 wherein said spring means includes first and second springs extending along opposite sides of said arm means.

5. Apparatus as recited in claim 4 wherein said first and second springs are coiled tension springs and said adjustment means includes peg means for connecting the ends of said first and second springs with said second openings in said spaced plates.

6. Apparatus as recited in claim 5 wherein said support means includes clamp means supporting said spaced plates and adapted to grasp a ledge.

7. Apparatus as recited in claim 5 wherein said support means includes adjustable, telescoping column means supporting said spaced plates for vertically positioning said ball.

8. Apparatus as recited in claim 1 wherein said support means includes clamp means adapted to grasp a ledge.

9. Apparatus as recited in claim 1 wherein said support means includes adjustable, telescoping column means supporting said apparatus for vertical positioning of said ball.

10. Apparatus as recited in claim 9 wherein said column means includes a base having a plurality of horizontally extending feet, an upright telescoping column and a plurality of adjustable braces extending between said feet and said column.

* * * * *